US011175055B2

(12) United States Patent
de Oliveira

(10) Patent No.: US 11,175,055 B2
(45) Date of Patent: Nov. 16, 2021

(54) AIR HUMIDIFYING APPLIANCE

(71) Applicant: Alcione Rodrigues de Oliveira, Porto Alegre (BR)

(72) Inventor: Alcione Rodrigues de Oliveira, Porto Alegre (BR)

( * ) Notice: Subject to any disclaimer, the term of this patent is extended or adjusted under 35 U.S.C. 154(b) by 0 days.

(21) Appl. No.: 16/718,125

(22) Filed: Dec. 17, 2019

(65) Prior Publication Data

US 2020/0355382 A1 Nov. 12, 2020

Related U.S. Application Data

(63) Continuation-in-part of application No. 16/572,338, filed on Sep. 16, 2019, and a continuation of application No. 15/276,453, filed on Sep. 26, 2016, now Pat. No. 10,415,840, which is a continuation of application No. 14/371,698, filed as application No. PCT/BR2013/000027 on Jan. 23, 2013, now Pat. No. 9,453,650.

(60) Provisional application No. 62/844,023, filed on May 6, 2019, provisional application No. 62/781,563, filed on Dec. 18, 2018.

(30) Foreign Application Priority Data

Jan. 31, 2012 (BR) ..... 20 2012002194-9

(51) Int. Cl.

| | |
|---|---|
| ***B05B 3/10*** | (2006.01) |
| ***B01F 3/04*** | (2006.01) |
| ***F24F 6/12*** | (2006.01) |
| ***B05B 7/00*** | (2006.01) |
| ***B01F 5/18*** | (2006.01) |
| ***F24F 6/16*** | (2006.01) |
| ***F24F 6/06*** | (2006.01) |
| *F24F 11/56* | (2018.01) |
| *F24F 5/00* | (2006.01) |

(52) U.S. Cl.

CPC ..... *F24F 6/12* (2013.01); *B01F 3/04021* (2013.01); *B01F 3/04035* (2013.01); *B01F 3/04042* (2013.01); *B01F 5/18* (2013.01); *B05B 3/10* (2013.01); *B05B 3/1035* (2013.01); *B05B 7/0081* (2013.01); *F24F 6/06* (2013.01); *F24F 6/16* (2013.01); *B01F 2215/0091* (2013.01); *F24F 5/0035* (2013.01); *F24F 11/56* (2018.01)

(58) Field of Classification Search

CPC ..... F24F 6/16; F24F 6/06; F24F 6/12; B01F 3/04021; B01F 3/04035; B01F 3/04042; B01F 5/18; B05B 3/10; B05B 3/1035; B05B 7/0081

See application file for complete search history.

(56) References Cited

U.S. PATENT DOCUMENTS

| | | | | |
|---|---|---|---|---|
| 1,736,799 A * | 11/1929 | Planert | ..... | F24F 6/06 239/214 |
| 7,677,054 B2 | 3/2010 | Dos Santos | | |
| 8,720,869 B2 * | 5/2014 | Zhang | ..... | B01D 47/08 261/76 |

* cited by examiner

*Primary Examiner* — Robert A Hopkins
(74) *Attorney, Agent, or Firm* — Papalas PLLC

(57) ABSTRACT

BUILDING FEATURE APPLIED IN AIR-CONDITIONING APPLIANCE, capable of enriching the air with atomized water droplets in two stages, where in a first moment the water sent directly from the water supply network is pre-atomized in an appliance; being then delivered to the main atomizer, which produces the final atomization, creating an ultrafine mist that facilitates the thermal exchange between the mist and the air. The air-conditioning appliance must be associated to a fan so as to spread this mist to the room.

17 Claims, 7 Drawing Sheets

AIR HUMIDIFYING APPLIANCE

RELATED APPLICATIONS

This application is a continuation-in-part of U.S. application Ser. No. 16/572,238, entitled "Building Feature Applied in Air Conditioning Appliance", filed 16 Sep. 2019, the disclosure of which is hereby incorporated herein by reference in its entirety, which is a continuation of U.S. application Ser. No. 15/276,453, entitled "Building Feature Applied in Air Conditioning Appliance", filed 26 Sep. 2016, the disclosure of which is hereby incorporated herein by reference in its entirety, which is a continuation of U.S. application Ser. No. 14/371,698, entitled "Building Feature Applied in Air Conditioning Appliance", filed 10 Jul. 2014, the disclosure of which is hereby incorporated herein by reference in its entirety, which is a U.S. filing under 371 of international PCT/BR2013/000027, filed on 23 Jan. 2013, the disclosure of which is hereby incorporated herein by reference in its entirety, which claims the benefit of Brazil Patent Application BR20 2012002194-9, filed on 31 Jan. 2012, the disclosure of which is hereby incorporated herein by reference in its entirety.

This application claims priority from Provisional Application No. 62/781,563, entitled "Building Feature Applied in Air Conditioning Appliance", filed 18 Dec. 2018, the disclosure of which is hereby incorporated herein by reference in its entirety.

This application claims priority from Provisional Application No. 62/844,023, entitled "Building Feature Applied in Air Conditioning Appliance", filed 6 May 2019, the disclosure of which is hereby incorporated herein by reference in its entirety.

TECHNICAL FIELD

An air humidifying appliance that adds moisture to air to improve that air quality. The appliance is operative in a location, such as a building, a room, an area, or a vehicle, to enrich the air of the location with water droplets. The appliance is operative in two stages. In the first stage, water from a source is broken up into droplets. In the second stage, the droplets from the first stage are further broken up in to an ultra-fine mist. The ultrafine mist assists in the thermal exchange between object(s), plant(s), animal(s), and/or human(s) and the air. The ultrafine mist is also operative to moisturize the objects, plants, animals, and/or humans. The appliance operates in conjunction with an air distributing device such as a fan or a cooling air conditioner system.

BACKGROUND

The State of the Art of the air conditioning appliances work differently from the air conditioners. One main function of the air conditioning appliance is to improve the air quality of a room such as a bedroom, living-room or office.

Most of the air conditioning appliances may have four different functions, namely: heating the air, cooling the air, ventilating or exchanging the air, and humidifying the air.

Thus, the appliance is an excellent solution for the ones who live in cities and states of dry regions of the world, such as Brazil, where the air humidity is usually low in specific times of the year. For cities in which the air humidity is very high, the air conditioning appliance is not as efficient when compared to a region with a drier weather.

The air conditioning appliance may be used to substitute the air conditioning and the air humidifiers. Some more advanced models of air conditioning appliances also come with heating and ionizing resources.

There are basically two types of air conditioning appliances. The ones that are more common are the portable air conditioning appliances and stationary wall air conditioning appliances, which are bigger and their installations looks like a standard air conditioning.

The air conditioning appliances are good alternatives for the cooling air conditioning in cities where the humidity is low and they consume nine times less electrical energy than an cooling air conditioning. The lower the humidity and higher the temperature, the higher is the capacity of the air conditioning appliance to reduce the temperature of the room through evaporative cooling. For example, a reduction of 5 to 10 degrees Celsius in relation to the outside temperature is possible.

The known air conditioners use a water pump to pull the water from a reservoir and send it to the fan. This water reaches the fan and is atomized and spread in the room. This causes the temperature to go down due to the evaporation.

The documents mentioned in the patent are: BR 0.000.094-9; BR 0.104.775-2; BR 0.700.603-9; BR 8.602.976-2; BR 8.700.165-9; BR 8.800.202-0; BR 8.800.692-1; BR 8.801.015-5; BR 8.902.245-9; BR 8.900.950-9; BR 0.202.524-8.

DISCUSSION

Therefore, thanks to the pertinent issues regarding the state of the art previously addressed, one of the aims of the present model of utility, the development of an air conditioning appliance that does not use a water pump to pull the water from the reservoir to the fan. In the systems that use the water pump it is common to face interruptions in its functioning, due to problems with abrasive particle solids, collected from the air and sent back to the reservoir. The pump pulls these solids that go through the movable parts and wear them out.

Another problem with the reservoirs is the return of non-atomized water. This water carries particle solids that end up being deposited in the reservoir. This forms a layer that is ideal for the development of fungi and bacteria, besides bad smell when the appliance has not been used for some time.

Thus, the solution proposed to eliminate the water reservoir and pump is to capture water to be atomized directly from the water supply network, transforming it integrally in mist. Therefore, there is no water left for contamination.

SUMMARY

Embodiments of the invention are directed to an air conditioning appliance that comprises an electric motor for powering the appliance; a water source that provides water to the appliance; an atomizer component for atomizing a portion of the water into a mist, wherein the atomizer component is connected to the motor; a bowl that is located proximate to the atomizer component, wherein the bowl has a plurality of radial ridges on a upper part of the bowl and a basin on a lower part of the bowl that receives the portion of the water that is not atomized into mist; and a set of channels that delivers water from the water source to the atomizer component, and delivers the portion of the water that is not atomized into mist back to the atomizer component. Wherein the set of channels has a first channel that is substantially horizontal with respect to an orientation of the appliance, which provides the water from the water source to the atomizer component; and wherein the set of channels has a second channel that is arcuate and extends from the lower part of the bowl to the first channel to return the portion of the water that is not atomized into mist to the atomizer component.

BRIEF DESCRIPTION OF THE DRAWINGS

The characterization of the present application for patent of a utility model is done by means of a representative drawing of the construction disposition applied in an air conditioning appliance, in such a way that the equipment may be wholly reproduced by adequate technique, allowing a full characterization of the functionality of the object sought.

From the figure drawn, which expresses the best form or preferred form of the product idealized here, we base the foundations of the descriptive part of the report by means of a detailed and consecutive numbering, which explains aspects that might be unclear due to the chosen representation so as to clearly determine the protection here requested.

This figure is merely illustrative and may present some variation as long as they do not differ from what was initially requested.

Figure 1A:
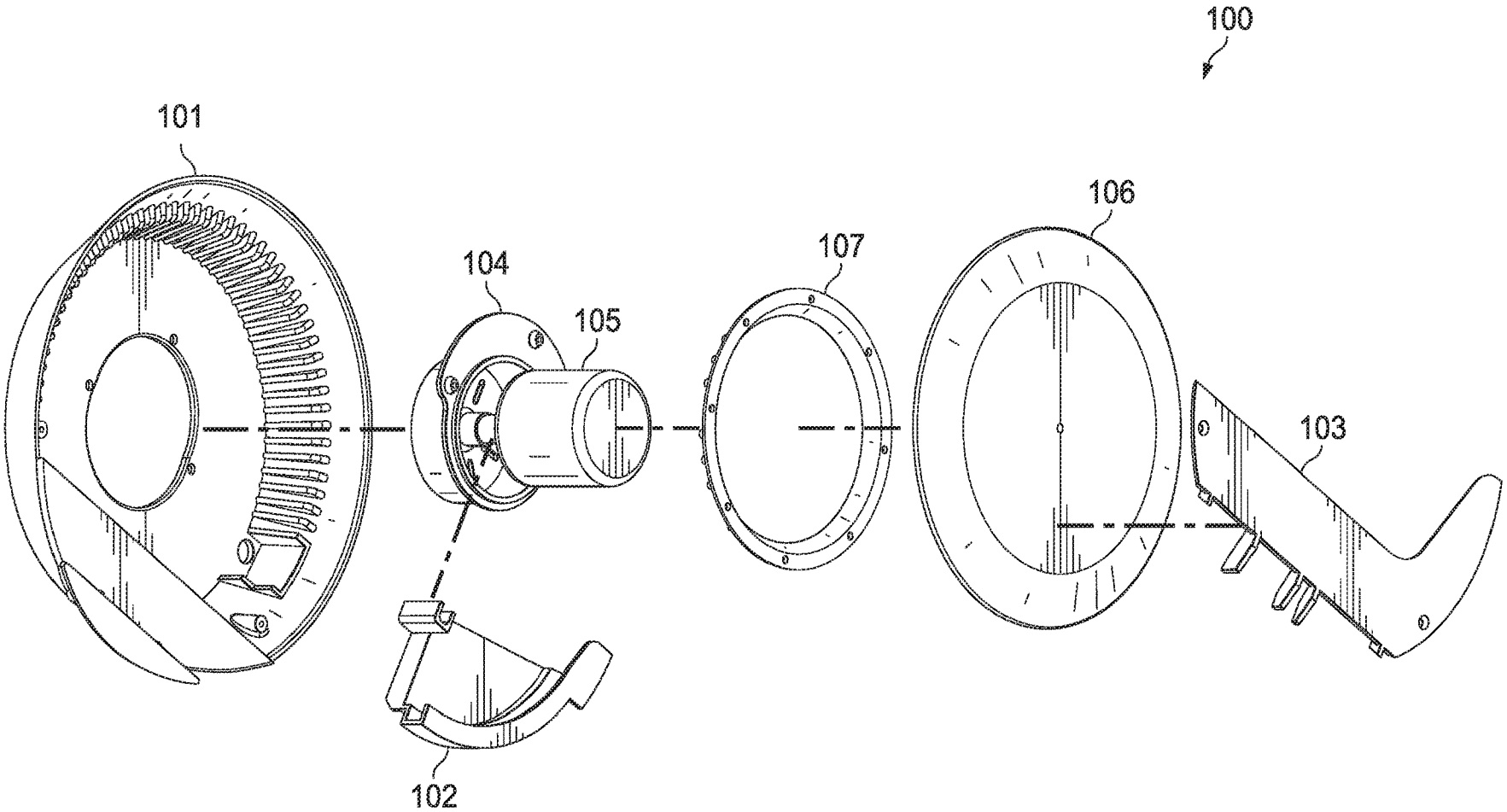
Figure 1B:
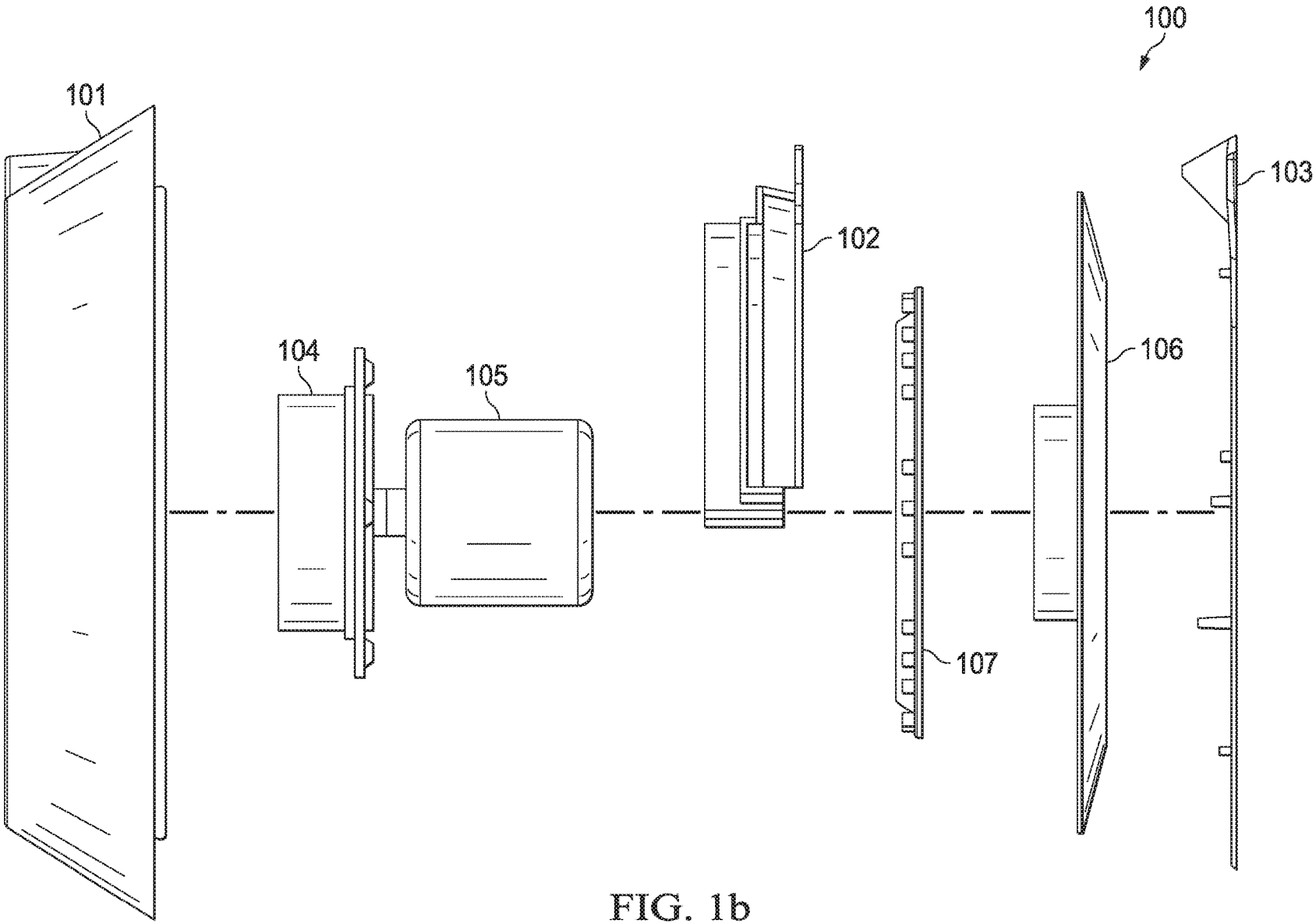
Figure 2:
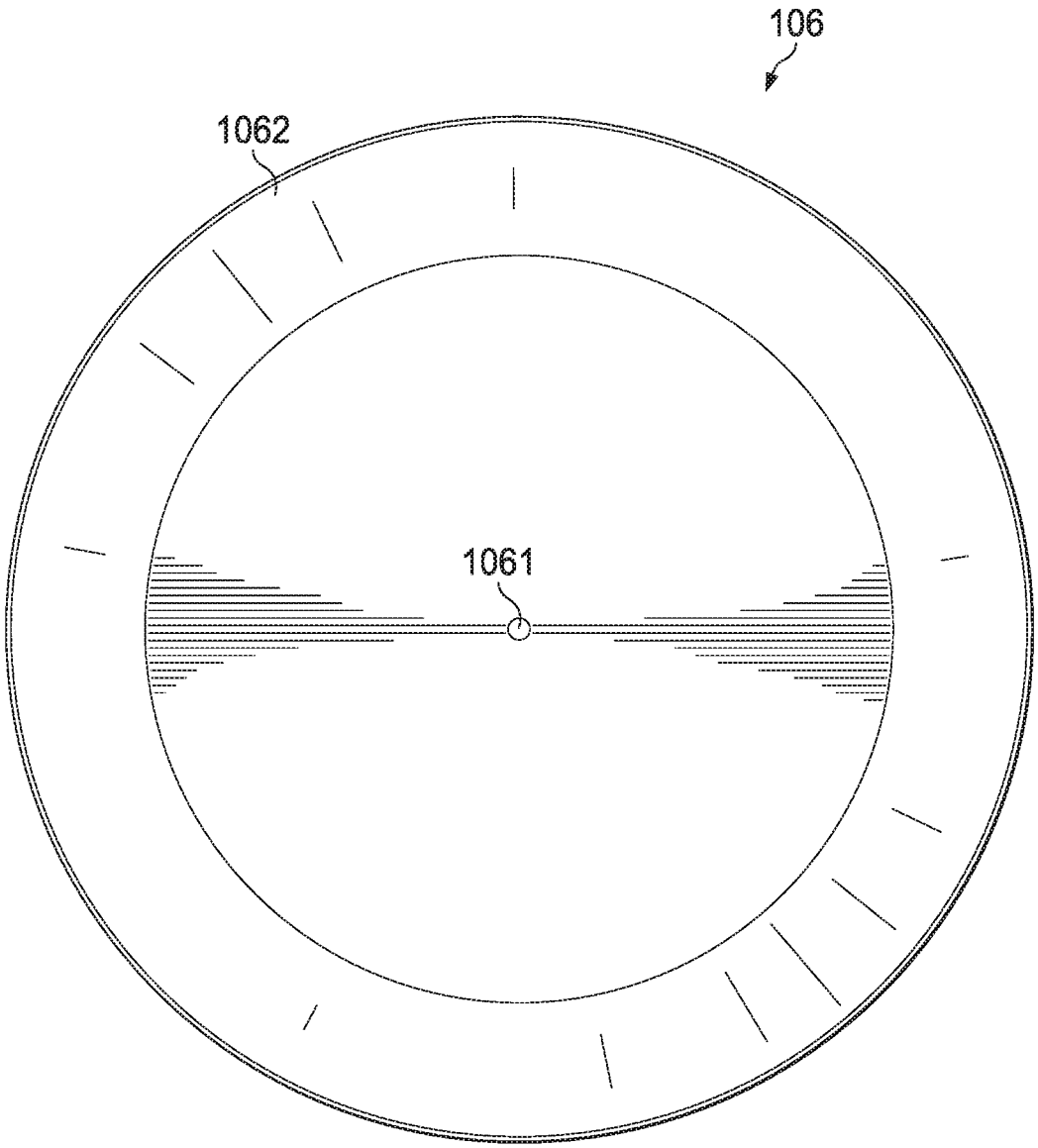
Figure 3:
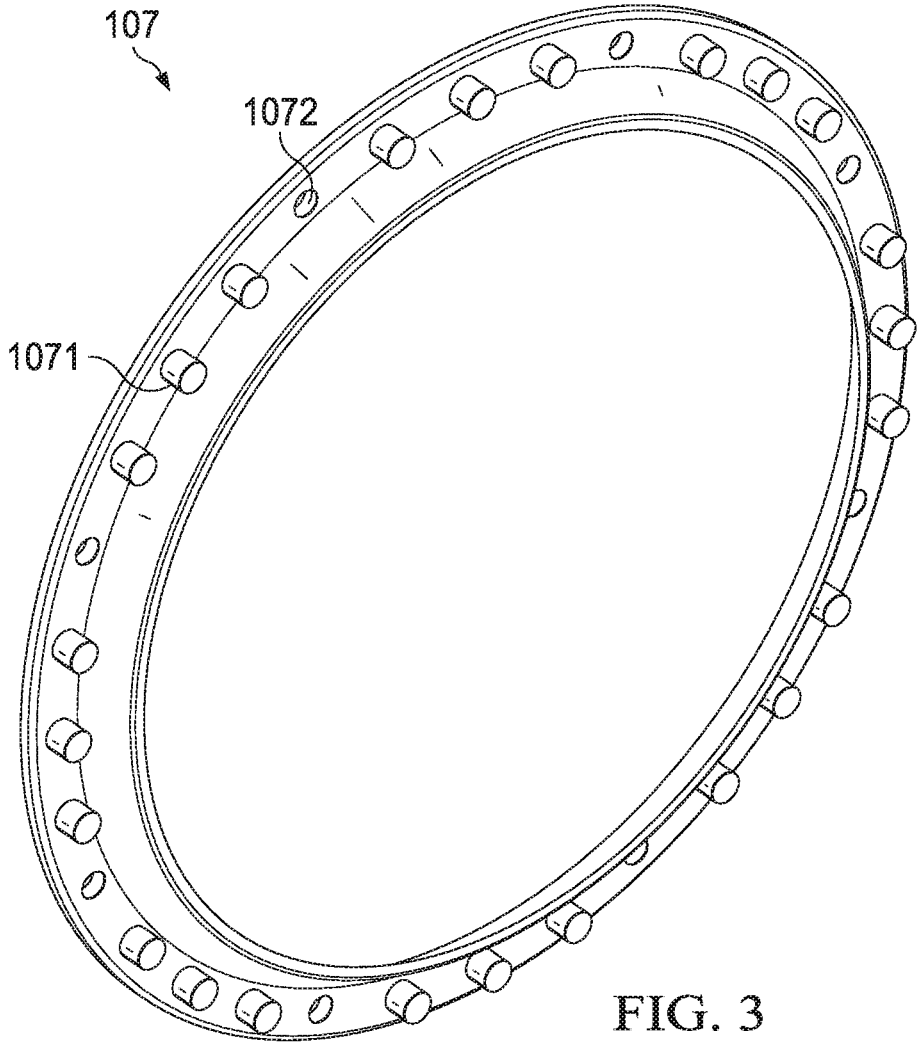
Figure 4:
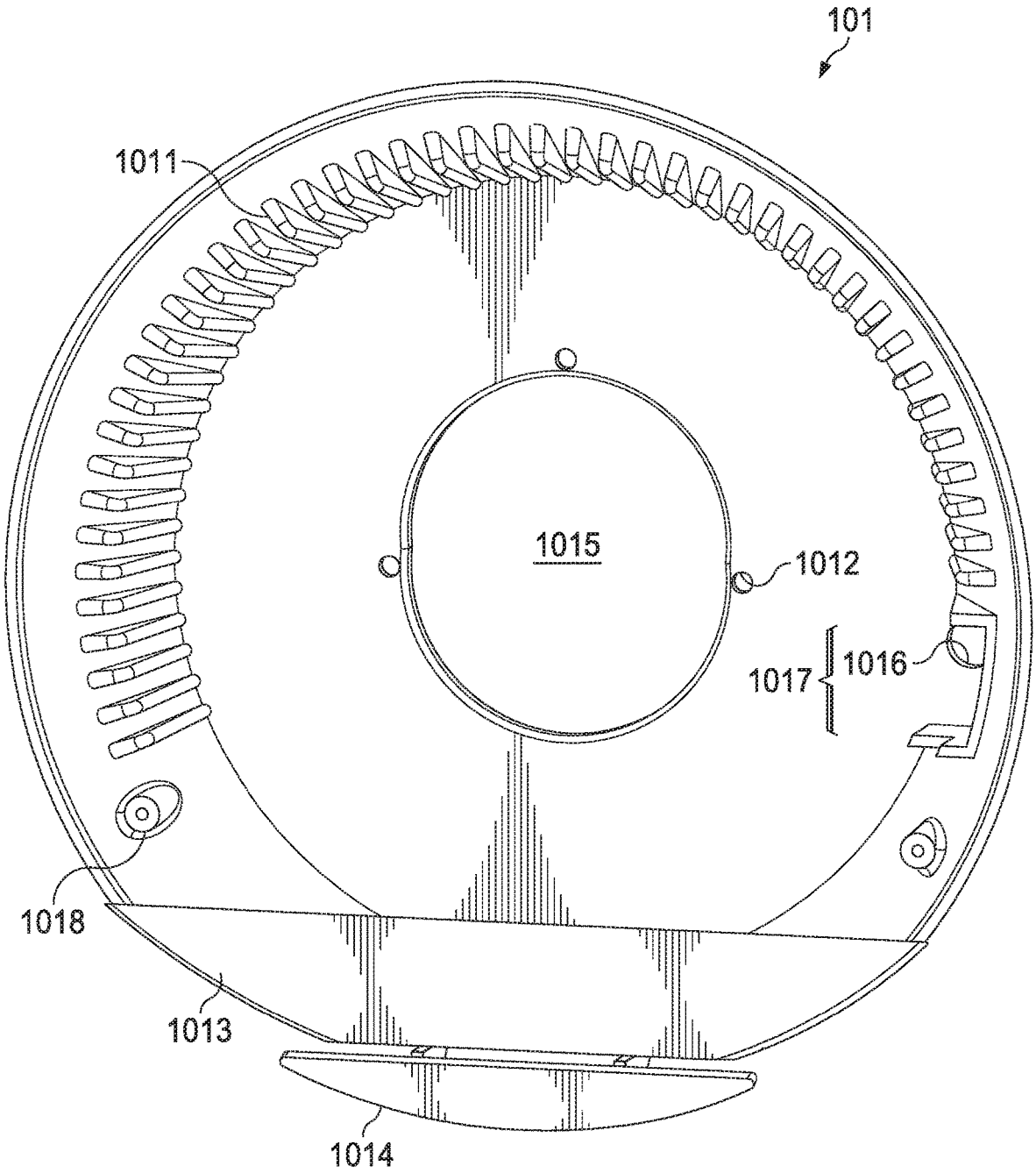
Figure 5:
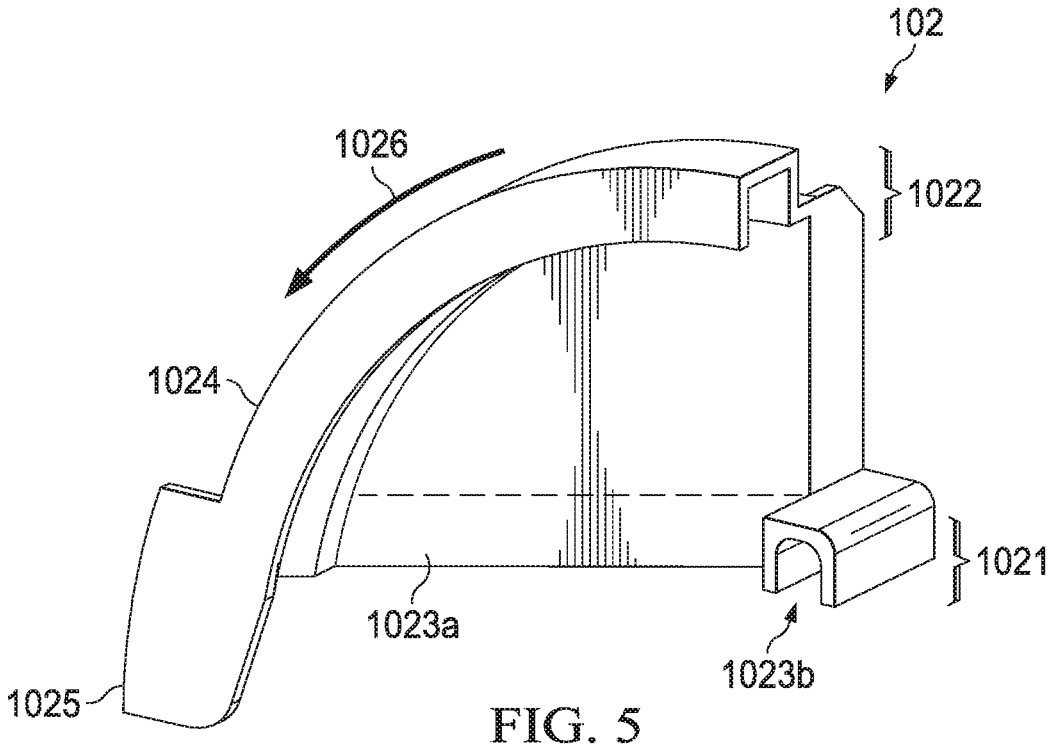
Figure 6:
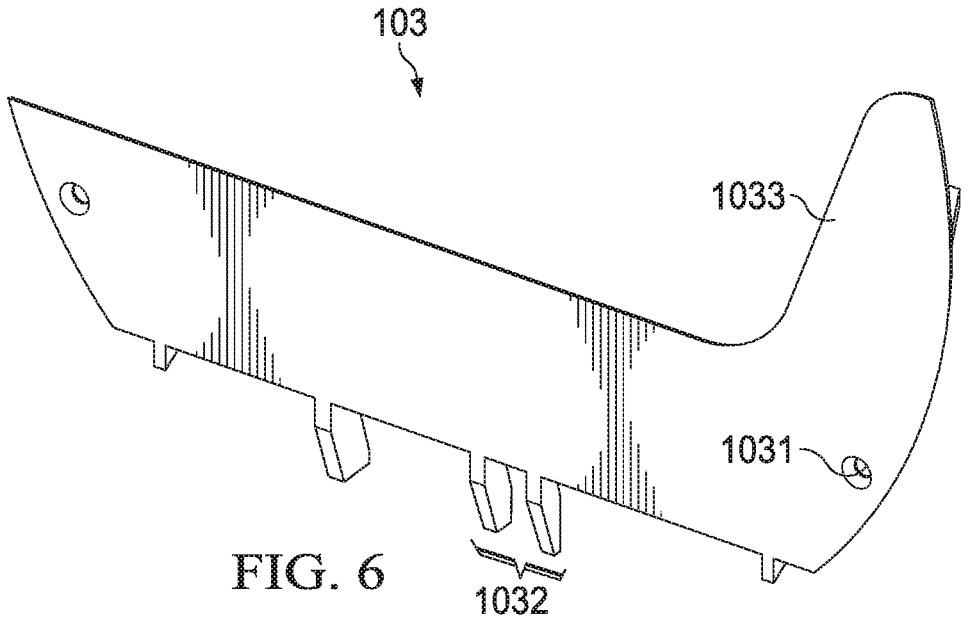

Having thus described the invention in general terms, reference will now be made to the accompanying drawings, which are not necessarily drawn to scale, and wherein:

FIGS. 1A and 1B depicts an exploded perspective view and an exploded side view of the various components of the appliance 100;

FIG. 2 depicts a front elevation view of the main disk atomizer 106;

FIG. 3 depicts a perspective view of the pre-atomizer 107;

FIG. 4 depicts a perspective view of the bowl 101;

FIG. 5 depicts a perspective view of the channel set 102;

FIG. 6 depicts a perspective view of the bib 103; and

Figure 7:
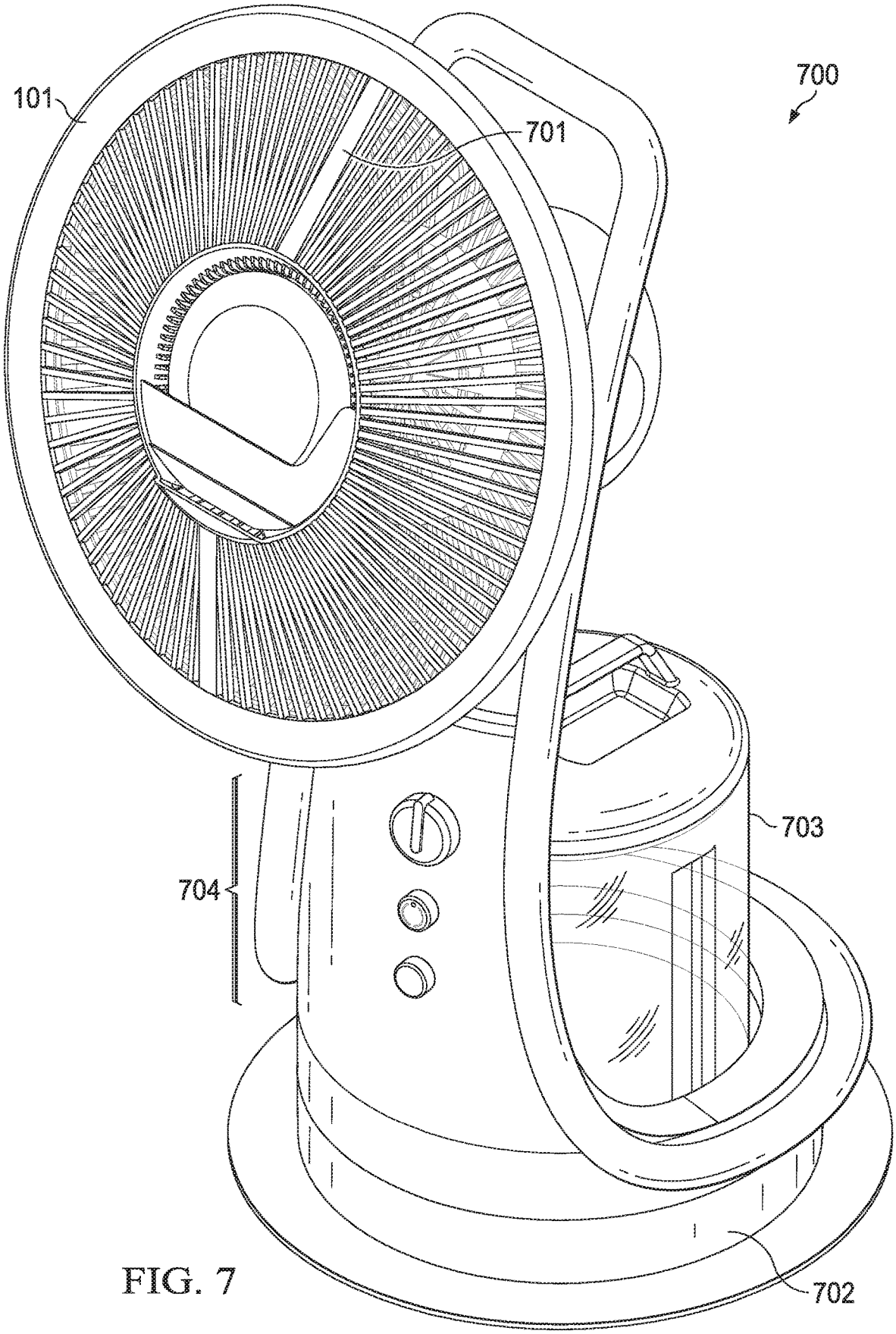

FIG. 7 depicts an example 700 of the appliance 100 connected with a fan 701.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1A depicts an exploded perspective view of the various components of the appliance 100. FIG. 1B depicts an exploded side view of the various components of the appliance 100. The appliance 100 comprises bowl 101, channel set 102, bib 103, motor fairing 104, electric motor 105, main disk atomizer 106, and the pre-atomizer 107. Note that in FIG. 1B, the electric motor 105 is adjacent to the channel set 102 and is not attached to the channel set 102. The electric motor 105 is located above the channel set 102 when assembled.

The appliance 100 includes electric motor 105. The motor is preferably a brushless motor that has a variable rotations per minute. Typically, the faster the motor turns, the more fine the mist that is produced by the appliance. The stator of the motor is preferably docked and glued in its bearing and/or bushing, such that housing of the motor 105 rotates. This allows the motor to be sealed to prevent water damage to the motor 105. The motor 105 is connected to the fairing 104. The fairing 104 is connected to the bowl 101. Thus, the motor 105, the main disk atomizer 106, and the pre-atomizer 107 are connected together and rotate together. The bowl 101, the fairing 104, the channel set 102, and the bib 103 are connected together and are stationary with respect to the motor 104/disk 106/pre-atomizer 107 assembly. The connections between the various pieces may be made via glue, screws, nuts and bolts, staples, clips, friction, or other fasteners. Note that various pieces may be made integral rather than separate. For example, the pre-atomizer 107 may be formed integral with the main disk 106. Similarly, the bowl may be connected to the fan via glue, screws, nuts and bolts, staples, clips, friction, magnets, or other fasteners.

FIG. 2 depicts a front elevation view of the main disk atomizer 106. The main disk atomizer 106 is connected to the electric motor 105 via hole 1061. The main disk atomizer fits into the bowl 101. The main disk atomizer is rotated by the electric motor 105 to form a disk of air that causes water located in the lower portion of the bowl 101 to be atomized. The disk of air is formed by the sloped portion 1062. The main disk atomizer 106 includes peg fittings (not shown) on the back side that allow for the pre-atomizer disk to be fastened to the main disk atomizer 106. The main disk atomizer 106 may include fins (not shown) located on the inner surface or on the outer surface (shown in FIG. 2), or both surfaces to aid in forming the air disk. The fins may be radial disposed similar to those fins 1011 of the bowl 101. The fins may also extend from the center and curve outward to the edge.

FIG. 3 depicts a perspective view of the pre-atomizer 107. The pre-atomizer 107 is fixedly connected to the inner surface of the main disk atomizer 106 via holes 1072. The holes 1072 would receive pegs (not shown) located on the inner surface of the main disk atomizer 106. The pre-atomizer 107 comprises a plurality of pins 1071. The pins fragment water that is located in a lower portion of the bowl 101. The fragmented water is then atomized by the air disk created by the main disk atomizer 106. The pins 1071 can be trimmed to balance the rotation of the assembly of the main disk 106 and the pre-atomizer 107.

FIG. 4 depicts perspective view of the bowl 101. The bowl comprises a plurality of radial ribs 1011 disposed in the upper portion of the bowl 101. The ribs 1011 assist the main disk atomizer 106 in forming the water mist. The bowl includes holes 1012 that allows the bowl 101 to be connected to the electric motor 105 and the motor fairing 104. Flange 1013 forms a water reservoir in the lower half of the bowl 101. The air disk created by the main disk 106 rotor acts on the water in the reservoir. The bowl includes an air deflector 1014 to deflects the air stream from the fan to lessen and/or prevent dripping by condensation. The bowl 101 includes an oblong hole 1015 to allow an assembly of the main atomizer 106, the pre-atomizer 107, the electric motor 105, and the fairing 104 to fit into the bowl 101. Additional holes or other features (not shown) allow the bowl 101 to be connected to an external fan. The bowl 101 includes water inlet hole 1016 that allows water to be provided to the bowl 101 and the appliance 100. The bowl also includes fitting 1017 that couples the bowl to the channel set 102. The bowl includes holes 1018 to connection with the bib 103.

FIG. 5 depicts a perspective view of the channel set 102. The channel set 102 comprises an upper portion 1021 and a lower portion 1022. The channel set comprises a first channel or horizontal channel 1023*a* and 1023*b* that resides in the upper portion. Note that the portion 1023*a* is hidden in this view. The horizontal channel 1023*a*, 1023*b* provides water directly to the main disk atomizer 106. The channel set comprises a second channel 1024 that is curved and moves from the lower portion 1021 to the upper portion 1022. The rotation of the air disk created by the main disk atomizer 106 acts to move unused water back up along the second channel or curved channel 1024 back to the horizontal channel 1023*a*, 1023*b*. Arrow 1026 shows the direction of the air disk created by the main disk atomizer 106 and also shows the direction of the rotation of the electric motor 105. The flange portion 1025 of the channel set 102 fits into the fitting 1017 of the bowl 101 to form the water inlet for the appliance. Note that channel 1023*a*, 1023*b* carries both new water from the water inlet and recycled water from the reservoir of the bowl 101, and channel 1024 carries recycled water from the reservoir of the bowl 101.

FIG. 6 depicts a perspective view of the bib 103. The bib 103 acts to condense the mist/water not projected into the air and return the water for reprocessing or recycling. The bib includes holes 1031 to connect the bib 103 to holes 1018 of the bowl 101 via fasteners (not shown). The bib 103 includes one or more baffles 1032 to direct the air generated by rotating the main atomizer 106 inside the curved channel 1024 of the channel set 102 and thereby dragging the unused water back up to the horizontal channel 1023*a*, 1023*b*. Flange 1033 also acts to direct the air disk to move the water up the curved channel 1024. The baffles 1032 also act to block peripheral air currents to the main atomizer that would throw water out of the bowl.

FIG. 7 depicts an example 700 of the appliance 100 connected with a fan 701. The appliance 100 is mounted in the center of the fan 701. The fan 701 includes base 702, water tank 703 and controls 704. The fan 701 rotates with the base 702. The fan 701 with the appliance 100 can also move up and down along the vertical axis, for example up 25 degrees from horizontal and down 25 degrees from horizontal. Also note that the fan 701 may move both horizontally and vertical at the same time, e.g. a circle or oval pattern.

Note that in this example, the water tank 703 is stationary and the base 702 rotates about the tank 703. The tank 703 may be removed from the base 702 and filled at a separate water source, e.g. a sink. The controls 704 turn the appliance 100 on and off, and regulates the amount of water flowing into the appliance 100.

Note that the example of FIG. 7 has the controls 704 mounted on the appliance/fan 700. Other embodiments may use a remote control (not shown), e.g. a separate control wand or an application on a cell phone. Other embodiments may use both the control 704 and a remote control.

The Example 700 operates as follows. Water from the tank 703 is provided to the appliance 100 via a hose, pipe, or other conduit (not shown). Note that in other embodiments the water may be provided from a water source such as municipal utility water, or natural water source such as a river, lake, etc.

The water enters the appliance 100 via hole 1016 in the bowl 101. The amount of water entering the appliance may be controlled by an electro-valve (not shown). The valve may be set to a desired amount or the valve may operate based on a humidity reading of the area in which the appliance 100 is operating.

When the appliance 100 is turned off, the valve is closed, and the new or fresh water is shut off and prevented from entering into the appliance 100. As the motor 105 spins down, most or all of the water remaining in the appliance 100 is consumed during the spin down.

When the appliance 100 is turned on, the new or fresh water travels down the horizontal channel 1023*a*, 1023*b* to the main disk atomizer 106, whereby the rotation of the main disk atomizer 106 and the pre-atomizer 107 acts to form most of the water into mist. The mist is then carried into the area by the fan 701.

The appliance 100 turns the water a mist via two stages. The pre-atomizer fragments the water from the horizontal channel 1023*a*, 1023*b* into droplets. The droplets are then provided to the main disk atomizer 106 that changes the droplets into a mist. The faster the rotation of the main disk atomizer 106, the finer the mist. The mist that is produced is ultrafine, which improves the thermal exchange between the atomized water and the air in the environment.

Any remaining new or fresh water not turned into mist then condenses into the basin of the bowl 101. The rotation of the main disk atomizer 106 and the pre-atomizer 107 moves the recycled water up the curved channel 1024 back up to the horizontal channel 1023*a*, 1023*b*, where the water is then formed into mist. Note that the main disk atomizer 106 does not contact the recycled water, the air disk moves the water up the curved channel 1024. This feedback of the unused or unconsumed water continues until the appliance is turned off. Thus, all or most of the water that enters the appliance is consumed by the appliance, no water is returned to the tank 703.

The air-conditioning appliance should be associated with a fan or other air moving device, in which the flow of air created by the fan or device carries the mist to the environment surrounding the appliance, thereby allowing a thermal exchange of water-air, thus reducing the heat of the environment and providing moisture to the environment.

Note that in FIG. 7, there is a single appliance associated with the single fan. However, other embodiments may have multiple appliances associated with a single fan. Note that each appliance may have its own associated water supply or may share a common water supply with one or more appliances.

Other embodiments may have a plurality of fans 701, each having one or more appliances 100. Such multiple fans may move together pointing in a similar direction. Such multiple fans may point at different locations. Such multiple fans may be moving together, pointing in similar directions, or may be moving independently of each other.

Note that the tank in FIG. 7 is a stand-alone tank. Other embodiments may have the tank connected to a water supply and use an auto-fill mechanism to refill that tank. Other embodiments may not use a tank, but rather are directly connected to a water supply or a pump that is connected to a water supply.

Note that in FIG. 7, the embodiment of the appliance has a motor that is separate from the fan motor. Other embodiments the appliance may use a single motor to operate both the appliance and the fan.

Note that in FIG. 7, the embodiment of the appliance is separate from the fan and is attached to the fan. In other embodiments, the appliance may be made integral with the fan.

The embodiment of FIG. 7 may be located within a room, an outdoor area e.g. a patio, a hunting blind or game stand, a garage, a business, a store, a office, a bar, a pub, a restaurant, a medical facility, an animal enclosure, a pet house, a pet terrarium, and a green house.

The embodiment of FIG. 7 may be located within a vehicle, such as a car, truck, airplane, golf cart, all terrain vehicle, boat, or train. The embodiment of FIG. 7 may be modified to attach to an air duct of automobile or other vehicle. The power for such an embodiment may be provided by plugging the appliance into a cigarette lighter, USB port, power port, or battery. The water source may be a bottle of water, e.g. located in drink holder. The bottle may be connected to the appliance using a stopper. The stopper may be cone-shaped to allow for different sized bottle opening. The appliance may use a gravity to provide the water by placing the water bottle higher than the appliance, e.g. on the vehicle dash.

The embodiment of FIG. 7 may be modified to attach to an air duct of commercial jet airplane. Such an embodiment may be similar to the automobile embodiment described above.

As described herein, the appliance uses water. However other liquids may be used. For example, alcohol, oil, other solvent, water mixed with other liquids, bug repellant, mosquito repellant, colored liquids, dyes, paints, luminous liquids (e.g. the liquid from a glow stick), medicines, disinfectants, scented liquids, essential oils, and/or air deodorizers may be turned into a mist by the appliance. Any liquid that may be turned into a mist and dispersed by the appliance may be used. If heavy liquids are used then a stronger motor may be needed to turn the liquid into a mist.

Such embodiments can be used to provide an interesting paint pattern to a wall or object.

Such embodiments can be used to disperse disinfectants in a room to clean the room or the air of the room.

Such embodiments can be used to spray medicine (inhalable or otherwise absorbable through skin, lungs, nasal cavities) to a number of persons in a room, may include stimulates, sedatives, other mood enhancers or combinations thereof.

Such embodiments can be used to deodorize a room or the air in a room.

Such embodiments can be used to dispense a scent into the room or area, for example, seasonal scents, e.g. pine for winter, pumpkin and cinnamon for fall, flowers for spring, citrus for summer.

Such embodiments can be used to dispense food smells to entice customers to enter a restaurant.

Such embodiments can be used to disperse color or luminous droplets for entertainment.

Note that care should be taken to ensure that the liquid is breathable by humans, plants, and/or pets or other animals. The liquids described above can be mixed in with the water source or added to the tray.

The appliance can be made of transparent or translucent material for decorative purposes and can include one or more lights to illuminate portions of the appliance for decorative purposes.

The appliance can be formed from plastic, metal, wood, fiberglass, carbon fiber, ceramics, glass or combinations thereof.

As used herein, the words "comprise," "have," "include," and all grammatical variations thereof are each intended to have an open, non-limiting meaning that does not exclude additional elements or steps.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An air conditioning appliance comprising:

an electric motor for powering the appliance;

a water source that provides water to the appliance;

an atomizer component for atomizing a portion of the water into a mist, wherein the atomizer component is connected to the motor;

a bowl that is located proximate to the atomizer component, wherein the bowl has a plurality of radial ridges on a upper part of the bowl and a basin on a lower part of the bowl that receives the portion of the water that is not atomized into mist; and a set of channels that delivers water from the water source to the atomizer component, and delivers the portion of the water that is not atomized into mist back to the atomizer component;

wherein the set of channels has a first channel that is substantially horizontal with respect to an orientation of the appliance, which provides the water from the water source to the atomizer component; and wherein the set of channels has a second channel that is arcuate and extends from the lower part of the bowl to the first channel to return the portion of the water that is not atomized into mist to the atomizer component.

2. The air conditioning appliance of claim 1, wherein the atomizer component rotates to atomize the portion of the water into the mist, and wherein placement of the second channel corresponds with a direction of rotation of the atomizer component to move water from the basin to the first channel.

3. The air conditioning appliance of claim 1, wherein the atomizer component rotates to atomize the portion of the water into the mist, and wherein the first channel receives the water from the water source at a location that is peripheral to the rotation of the atomizer component and moves that water to a location that is central to the rotation of the atomizer component.

4. The air conditioning appliance of claim 3, wherein the second channel moves the water from the basin to a location of the first channel that is adjacent to the water received from the water source.

5. The air conditioning appliance of claim 1, wherein the water source comprises a valve that controls an amount of water in the flow.

6. The air conditioning appliance of claim 1, wherein when the air-conditioning appliance is turned off, a portion of the water remaining in the set of channels and the basin is consumed by an inertial rotation of the atomizer component.

7. The air conditioning appliance of claim 1, wherein the atomizer component comprises:

a pre-atomizer that fragments the water into droplets, wherein the droplets are provided to the main atomizer that transforms the droplets into the mist.

8. The air conditioning appliance of claim 7, wherein the pre-atomizer comprises a plurality of peripheral fins to fragment the water.

9. The air conditioning appliance of claim 1, wherein the water source is one of a water network and a tank.

10. The air conditioning appliance of claim 1, wherein the water that is provided to the atomizer component is not returned to the water source.

11. An air conditioning appliance comprising:

a motor for powering the appliance;

a liquid source that provides a liquid to the appliance;

an atomizer component for atomizing a portion of the liquid into a mist, wherein the atomizer component is connected to the motor;

a bowl that is located proximate to the atomizer component, wherein the bowl has a basin on a lower part of the bowl that receives the portion of the liquid that is not atomized into mist; and a set of channels that delivers liquid from the liquid source to the atomizer component, and delivers the portion of the liquid that is not atomized into mist back to the atomizer component;

wherein the set of channels has a first channel that is substantially horizontal with respect to an orientation of the appliance, which provides the liquid from the liquid source to the atomizer component; and wherein the set of channels has a second channel that is arcuate and extends from the lower part of the bowl to the first channel to return the portion of the liquid that is not atomized into mist to the atomizer component.

12. The air conditioning appliance of claim 11, wherein the air conditioning appliance is associated with an air moving device, the mist is provided to a stream of air from the air moving device.

13. The air conditioning appliance of claim 12, wherein the air moving device is one of a fan and an air duct of a vehicle.

14. The air conditioning appliance of claim 12, wherein the air moving device is integral with the air conditioning appliance.

15. The air conditioning appliance of claim 11, wherein the air conditioning appliance is one of a plurality of air conditioning devices, wherein each air conditioning device is associated with a respective air moving device, the mist of each air conditioning device is provided to a stream of air from its respective air moving device.

16. The air conditioning appliance of claim 11, wherein the air conditioning appliance is one of a plurality of air conditioning devices, wherein each air conditioning device is associated with one air moving device, the mist of each air conditioning device is provided to a stream of air from the one air moving device.

17. The air conditioning appliance of claim 11, wherein the liquid comprises at least one of:

water, alcohol, oil, solvent, water mixed with other materials, bug repellant, mosquito repellant, colored liquid, dye, paint, luminous liquid, medicine, disinfectant, scented liquid, essential oil, and an air deodorizer, and combinations thereof.

* * * * *